US007810576B2

(12) United States Patent
Reick

(10) Patent No.: US 7,810,576 B2
(45) Date of Patent: Oct. 12, 2010

(54) MOBILE SMOKE CONTROL AND FIRE PROTECTION DEVICE

(76) Inventor: Michael Reick, Schmalzgartenweg 5, D-73054 Eislingen/Fils (DE)

( * ) Notice: Subject to any disclaimer, the term of this patent is extended or adjusted under 35 U.S.C. 154(b) by 0 days.

(21) Appl. No.: 11/826,010

(22) Filed: Jul. 11, 2007

(65) Prior Publication Data

US 2008/0041598 A1 Feb. 21, 2008

Related U.S. Application Data

(63) Continuation of application No. PCT/EP2006/000091, filed on Jan. 9, 2006.

(30) Foreign Application Priority Data

Jan. 11, 2005 (DE) ..... 10 2005 001 211
May 2, 2005 (DE) ..... 20 2005 007 137 U

(51) Int. Cl.

| | |
|---|---|
| ***A62C 2/00*** | (2006.01) |
| ***A62C 8/00*** | (2006.01) |
| ***A62C 25/00*** | (2006.01) |
| ***A62C 27/00*** | (2006.01) |
| ***A62C 29/00*** | (2006.01) |

(52) U.S. Cl. ..... 169/45; 169/48; 169/49; 169/50; 169/52

(58) Field of Classification Search ..... 169/45, 169/48, 49, 50, 52
See application file for complete search history.

(56) References Cited

U.S. PATENT DOCUMENTS

| | | | | |
|---|---|---|---|---|
| 3,434,252 | A | 3/1969 | Dobson | |
| 3,960,216 | A * | 6/1976 | Isobe | 169/48 |
| 5,188,186 | A * | 2/1993 | Nash | 169/48 |
| 5,542,463 | A * | 8/1996 | Pinkalla et al. | 160/273.1 |
| 6,070,640 | A * | 6/2000 | Miyagawa et al. | 160/121.1 |
| 6,884,160 | B1 * | 4/2005 | Sundholm | 454/191 |

FOREIGN PATENT DOCUMENTS

| | | |
|---|---|---|
| CH | 178 693 | 7/1935 |
| DE | 296 08 290 | 7/1996 |
| DE | 298 05 216 | 5/1998 |
| JP | 2003 111860 | 4/2003 |

* cited by examiner

*Primary Examiner*—Len Tran
*Assistant Examiner*—Ryan Reis
(74) *Attorney, Agent, or Firm*—Muncy, Geissler, Olds & Lowe, PLLC

(57) ABSTRACT

A mobile smoke control and fire protection device for buildings is provided. The device comprises a sealing unit that can be applied to, or inside, an opening of a wall, a ceiling or a floor, is adapted to the opening in terms of the shape and size thereof, and is provided with at least one passage for people and/or at least one passage for tools, firefighting equipment, and the like. The passage for people and/or the passage for equipment can be least partially covered.

36 Claims, 4 Drawing Sheets

MOBILE SMOKE CONTROL AND FIRE PROTECTION DEVICE

This nonprovisional application is a continuation of International Application No. PCT/EP2006/000091, which was filed on Jan. 9, 2006, and which claims priority to German Patent Application Nos. DE 102005001211 and DE 202005007137, which were filed in Germany on Jan. 11, 2005 and May 2, 2005, respectively, and which are all herein incorporated by reference.

BACKGROUND OF THE INVENTION

1. Field of the Invention

The present invention relates to a mobile smoke control and fire protection device in buildings and a method for preventing a propagation of smoke and fire in physical structures.

2. Description of the Background Art

In a case of fire, the fire department generally uses a stairway area as a route of attack. A door, for example, an apartment door behind which the fire is located, is opened by the fire department. After entering the burning room, the entrance door has to remain open, at least ajar, due to the hose of the fire department. The same applies when further persons enter or leave the fire area. In this case the door has to be opened even wider. The opening of a door behind which the fire is located and also the necessity of keeping the door at least partially open leads in most cases to a propagation of smoke and consequently to a danger for people as a result of fire smoke and with it to an increase of fire damage. Also in the cases in which the fire is not directly located behind the entrance door and/or the apartment door but in another room of the apartment, an increase in damage due to smoke propagation throughout the entire apartment and from there also extending out to the stair way area is caused by the opening of the door behind which the fire is located and its remaining open during the fire extinguishing procedure. The increase in damage will be even larger if a door has had to be forced opened since the latter can then no longer be safely closed at all. The same also applies of course for offices, practices and other units in use in a building.

Alternative attack routes, for example, through a window in the fire area, firstly are more complicated, in part, more difficult and/or more dangerous for the task forces and furthermore are also not generally realizable.

The smoke problem is already sought to be minimized through so-called positive pressure ventilation by means of high-performance ventilators. These are supposed to generate a relative positive pressure and to force an air current which reduces a further entry of smoke in a stairwell. Practice has shown however that this positive pressure ventilation cannot always be implemented successfully. For larger buildings and also for publicly used buildings structural requirements to prevent the spread of smoke and fire are frequently specified by building codes, such as for example fire doors, but when fire doors have to be passed through and, for example, equipment and fire hoses have to be led through, their functionality ceases to exist because also in this case the fire door and/or smoke protection door can often no longer be closed.

In order to avoid a propagation of smoke when a door can no longer be closed, it is already known from DE 296 08 290 U1 to generate an air curtain to secure a passage, whereby air in the area of the passage is supposed to flow from the top down in sufficient strength in order to prevent the penetration of smoke or fire. Such a means, however, has only a limited effect and has to be mounted stationary on all relevant doors. In addition, the air supply can have a detrimental effect for the spreading of the fire and due to the air current generated it can result in an increase in the smoke gas volume due to turbulence.

From DE 298 05 216 U1 a fixed smoke control door is known which is installed in a building in which the door leaf and/or the door frame is provided in the lower region with a utility passage for a fire hose or suchlike.

The disadvantage with this fire door, however, is that the latter has to be present in a correspondingly large number in a building. In addition to a visually unattractive design, the utility passage in the manner of an access opening for small animals such as cats, for example, is a weak spot in the event of a burglary and weakens the mechanical stability of a door leaf.

SUMMARY OF THE INVENTION

It is therefore an object of the present invention to provide a mobile smoke control and fire protection device with which the fire department can seal openings in a building effectively, safely and rapidly in a case of fire, wherein the openings, however, should enable access for persons who are fighting the fire and/or a lead-through of equipment for fire fighting, if necessary, without appreciable smoke penetration.

An uncontrolled propagation of smoke can be prevented in particular with the smoke control and fire protection device according to the invention. Doors, in particular apartment doors, which are arranged toward a stairwell or a stairway area, generally open inwardly. This means the protective device according to the invention can be fitted in front of the door to be opened into the opening, for example into the door frame, thereby providing a "smoke seal" at least in the upper region of the opening. Only thereafter is the apartment door opened, with it being possible for the fire to be approached, or for equipment or fire fighting equipment, such as for example a fire hose, to be brought to the location of the fire through the passage opening and/or the lead-through opening in the sealing unit which is adapted in terms of shape and size to the opening in the building. Subsequently, the passage opening and/or the lead-through opening can be largely closed again.

If a door opens, by way of exception, counter to the attack direction of the task forces, the protection device according to the invention can be utilized immediately after opening the door. In this case, which only rarely occurs, the propagation of smoke can be controlled again already shortly after the installation.

Since smoke disperses upwardly, the passage for people and/or the passage for equipment is provided in the lower area of the sealing unit. In this way, the surrounding rooms, in particular a stairway area or stairwell, can remain smoke free or can be more rapidly de-smoked if smoke has already penetrated.

It is also advantageous that the rescue team for the deployed attack team can be available directly in front of the burning room behind the protection device according to the invention. In this way, longer paths are avoided and faster fire fighting is possible.

It is also advantageous that an attack team is already located in a largely safe area behind the protection device according to the invention after leaving the fire seat.

In an embodiment according to the invention, the sealing unit can be provided at least partially with a flexible material. In this way it is possible to fit the sealing unit to the various openings without any great difficulty.

In another embodiment, the flexible material used is a cloth or a foil which is resistant to high temperatures and resistant against the effect of flames.

For adaptation to the various openings, the sealing unit can be altered at least partially in terms of its dimensions. A possibility for this exists in expandable swelling elements which are attached at the circumference of the sealing unit and which can be inflatable, for example.

Alternatively, the sealing unit can also be provided with a tension or clamp frame which is preferably provided with adjustable frame members. As adjustable frame members, for example, telescopic frame members can be provided which adapt the sealing unit both in terms of height as well as width to the opening which is to be closed.

In an embodiment of the invention, it can be provided that the sealing unit is formed from two-part or multi-part sealing elements. In this way, the sealing unit can be more optimally adapted. Thus, for example, the sealing unit can be provided in the upper region with a tension frame and provide secure sealing here while in the lower region, a sealing element is provided which is of flexible design and is provided correspondingly formed for a passage opening and/or a lead-through opening. For this, the lower sealing element can be formed as a type of curtain, for example.

If the tensioning frame is formed so that it can be pulled out in the direction of the lower region, even better sealing is achieved. Thus, the passage opening or the lead-through opening can in this way for example be correspondingly reduced in size or even completely sealed when not in use.

A further advantage of the invention is that the protection device can remain in the opening after completion of the operation, i.e. after extinguishing the fire, wherein said protection device is provided with sealing elements such as, for example, adhesives or adhesive tape. In this case, an at least largely smoke-free closure at least can be achieved. If the possibility exists that smoke and odor can disperse through a window, for example, then the protection device according to the invention can remain for several days and it is avoided that the burnt smell spreads throughout the entire house and/or cannot be eliminated.

With the protection device according to the invention, significant health damage can be prevented in addition to very high levels of property damage. Not only in apartment block construction but also in modern buildings with an increasingly coherent air space, a simple possibility of smoke containment in a case of fire is provided in this manner by the fire department. Especially with modern buildings with multi-storeyed foyers or atriums, the positive pressure ventilation functions very poorly due to the generally high leakage rate of the large airspace and, on the other hand, due to the propagation of smoke into a large region, enormous damage occurs here due to smoke damage.

If one or more exhaust air openings are created in the space affected by a fire, a propagation of smoke is prevented in the rooms not affected by the fire.

The protection device according to the invention uses the physical thermal effect occurring in a room in the case of a fire, the so-called "chimney effect". With an exhaust air opening in the upper room area, which is generally formed by windows, the supply air opening in the lower region can be adjusted in a controlled manner by the protection device according to the invention. This results in an air current from the area which is supposed to be held smoke free (generally the stairway area) into the region affected by the fire, and a dispersion of fire smoke from the exhaust air opening in the upper region of the fire area. The protection device according to the invention therefore can prevent a propagation of smoke on the basis of this physical principle even without positive pressure ventilators. If the protection device according to the invention is supplemented with the use of positive pressure ventilators, the effectiveness of the forced air flow can be increased as the air flow in the building can be better controlled.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
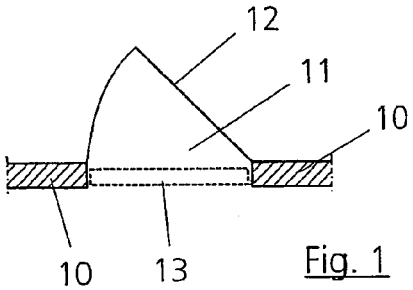
FIG. 1 illustrates a schematically simple layout plan of a building opening with a smoke control and fire protection device according to an embodiment of the invention when mounted in a wall level.

FIG. 1 shows a schematically simplified layout plan of a building opening 11 with a smoke control and fire protection device 13 according to the invention, which is designated in the following for simplification only shortened as "protection device", when mounted in a wall level 10. The protection device 13 is provided with a sealing unit which will be subsequently described in more detail. If a door leaf 12 opens in the direction of attack of the attack team, the protection device 13 can be mounted in the wall level 10 (in particular within the door case) already before the opening of the door. Often this accessible region is approximately as wide as the wall thickness in which the door is built in. In this case the smoke seal can be easily braced in the accessible region of the door frame.

Figure 2:
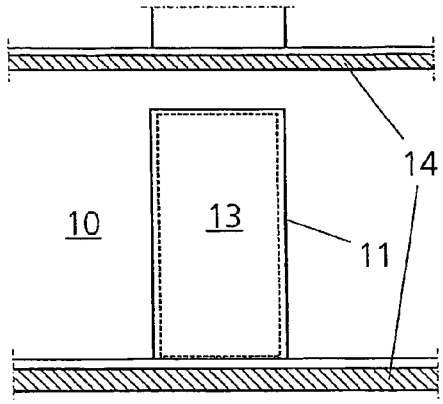
FIG. 2 illustrates a schematically simplified view of a building opening with the smoke control and fire protection device according to FIG. 1.

FIG. 2 shows a schematically simplified view after installation of the protection device 13 according to FIG. 1 in the wall level 10. For better orientation a lower and upper cover 14 is shown by way of example.

Figure 3:
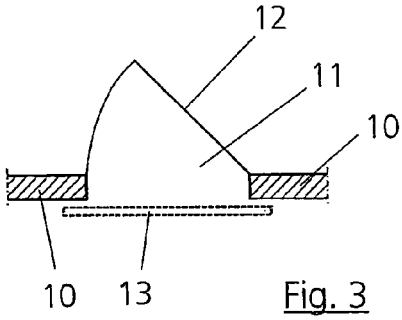
FIG. 3 illustrates a schematically simplified layout of a building opening with a smoke control and fire protection device according to the invention when mounted in front of a wall level.

FIG. 3 shows a schematically simplified floor plan of a building opening 11 of a protection device 13 when mounted in front of a wall level 10. This mounting alternative can be advantageous with a narrow wall. Furthermore, this mounting type should be regularly used when a door 12 opens up counter to the direction of the advancing task forces. In this case it is merely necessary to fasten the protection device 13 in any manner to the wall 10 in a largely sealing manner. This can be carried out, for example, by means of bolt guns for quick attachment by means of slats.

The protection device 13 can obviously not only be placed in door openings but also in ceilings or floors having the corresponding openings.

Figure 4:
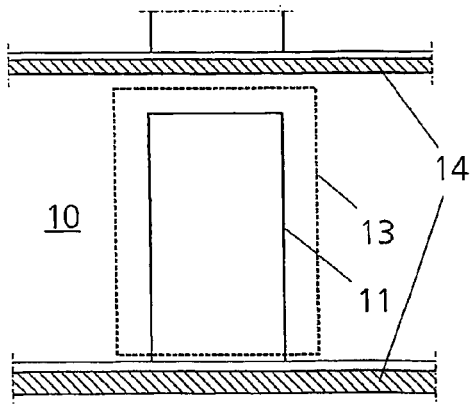
FIG. 4 illustrates a schematically simplified view of a building opening with the smoke control and fire protection device according to the invention according to FIG. 3.
Figure 5:
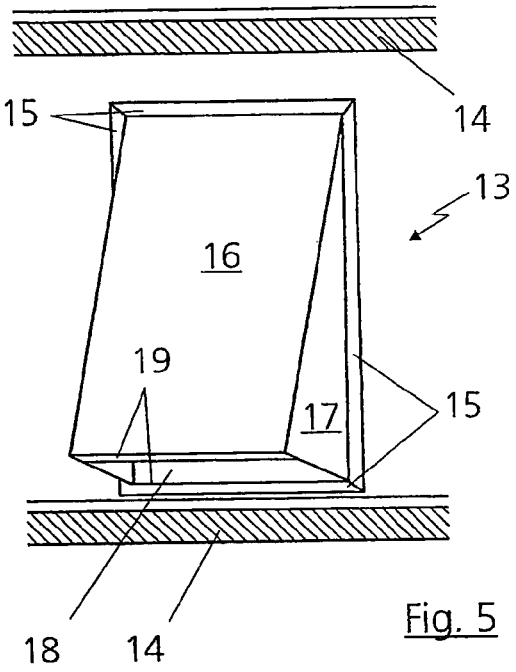
FIG. 5 illustrates a schematically simplified view of a building opening with a smoke control and fire protection device according to the invention in an alternative embodiment with a laterally closed curtain (perspective representation of the curtain)
Figure 6:
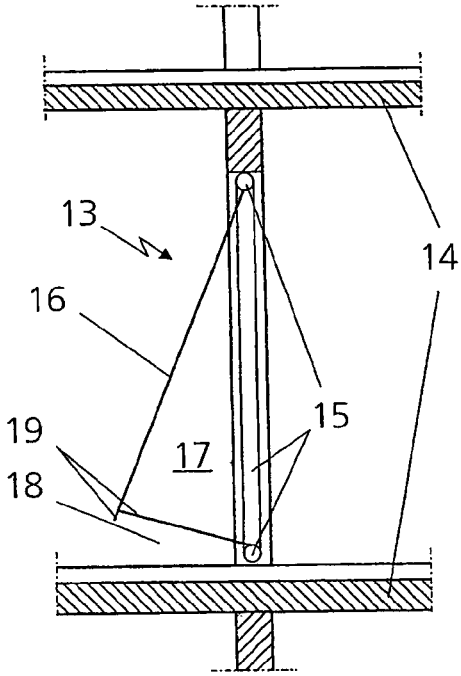
FIG. 6 illustrates a schematically simplified cross-section through a building opening with the smoke control and fire protection device according to the invention according to FIG. 5.

FIG. 4 shows a schematically simplified view after the installation of the protection device 13 according to FIG. 3 in front of the wall level 10.

FIGS. 5 to 12 show various further developments of the protection device 13 in which these adjustable sealing units can be adapted to different opening shapes and opening dimensions. For this purpose the protection device 13 is correspondingly braced or clamped in the opening.

FIGS. 5 to 8 show sealing units 16 made from flexible material that are at the periphery provided with a swelling element 15. The swelling element 15 can be designed in the manner of a rubber dinghy with a plurality of air chambers with valves and can be filled by a compressed air cylinder. This results in a completely tight adaptation to the existing opening. The sealing unit 16 can be provided laterally with likewise flexible side parts 17, for example, in triangular form. The lower edge of the sealing unit 16 can, for example, be fixed to the lower swelling element 15 by means of a hook-and-loop fastener 19.

When releasing the hook and loop fastener 19 the sealing unit 16 can be folded out forwards, thereby forming a passage opening 18 in the lower region for people or a lead-through opening for equipment for fire fighting. When not in use the sealing unit 16 can be tightly sealed again with the two side parts 17. The sealing unit 16 can also be firmly connected optionally via the flexible side parts 17 to the lateral swelling elements 15.

The installation of the protection device 13 in or in front of a building opening 11 can also occur mechanically, for example by being fastened with nails, screws or the like. A magnetic attachment is also possible, for example with a strip magnet which is arranged on the sealing unit 16 when a metal door case is present.

Alternatively, it is also possible to provide an adhesive connection to the walls surrounding the opening or to a door case.

When the protection device according to the invention has gained acceptance in fire fighting and, for example, every or almost every fire department is equipped with it, a further facilitation is achieved if, in the planning and construction of a building for the doors, in particular fire doors, a circumferential groove or recesses, bores, attachment members and suchlike are provided in the door frame or door case or in a wall section next to the door. Then in the event of a fire this groove can serve as the reception for the guide parts of the sealing unit 16 for their anchoring on the door case.

It is also possible that all the doors in a building are correspondingly pre-equipped and then in the event of a fire a protection device according to the invention is kept on location. With corresponding preparation on the doors the protection device can be quickly installed in the event of a fire and thus the resistance of every door is increased against a propagation of fire or smoke. This approach is advantageous in particular with large buildings such as, for example, administration buildings, hospitals, etc. and also in all cases when, in a company with its own fire department (a so-called private fire department), the protection device according to the invention which is used by the fire department is coordinated with the preparations at the individual doors.

Figure 7:
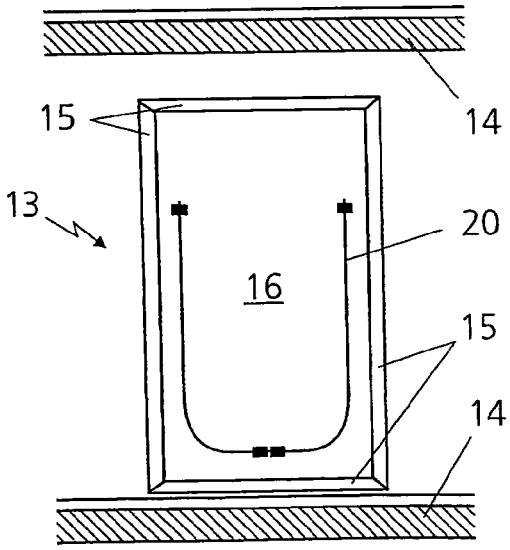
FIG. 7 illustrates a schematically simplified view of a building opening with a smoke control and fire protection device according to the invention in an alternative embodiment with a zipper.
Figure 8:
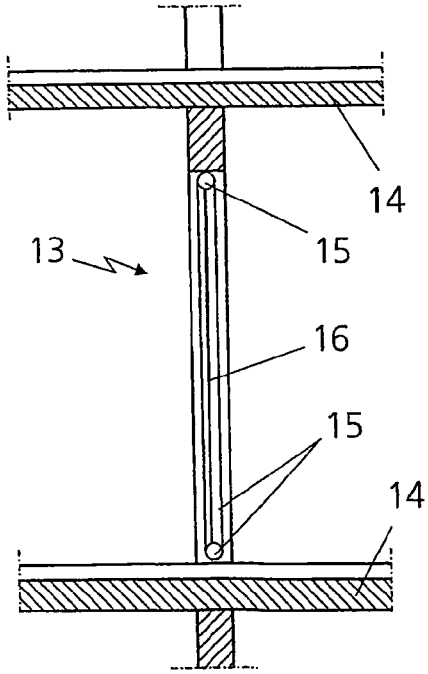
FIG. 8 illustrates a schematically simplified cross-section through a building opening with the smoke control and fire protection device according to the invention according to FIG. 7.

In FIGS. 7 and 8 an alternative embodiment is shown in which the sealing unit 16 can be closed by a zipper 20. In order to produce a passage opening and/or lead-through opening it is only necessary in this case to open the zipper, which is generally designed in two parts, correspondingly partially, preferably in the lower region. In this alternative embodiment the protection device 13 is generally situated within the wall level 10, as this can be seen from FIG. 8.

Instead of a peripheral swelling element 15 which is filled with air or reaction foam, an adaptation can of course also occur by pneumatic or hydraulic means (in particular cylinders). The same applies for mechanical adaptive members, as described in the following on the basis of FIGS. 9 to 12. In this alternative embodiment the sealing unit 16 is provided with a tensioning and clamping frame 21 having adjustable frame members 22. The adjustable frame members 22, for example, can be square profiles of aluminum which are formed as hollow bodies.

In this way, the frame members 22 can be designed so as to be non-rotatably slidable into each other and can when required be pulled out of each other telescopically whereby an adaptation to the opening which is to be sealed is attained in a simple manner. For this purpose, two lateral frame members running in the vertical direction and at least two frame members running in the horizontal direction, for example, can be provided, which frame members form a corresponding frame. With a non-flexible design of the corner connections, the two vertical frame members, if applicable, can also be connected by only one horizontal frame member.

Figure 9:
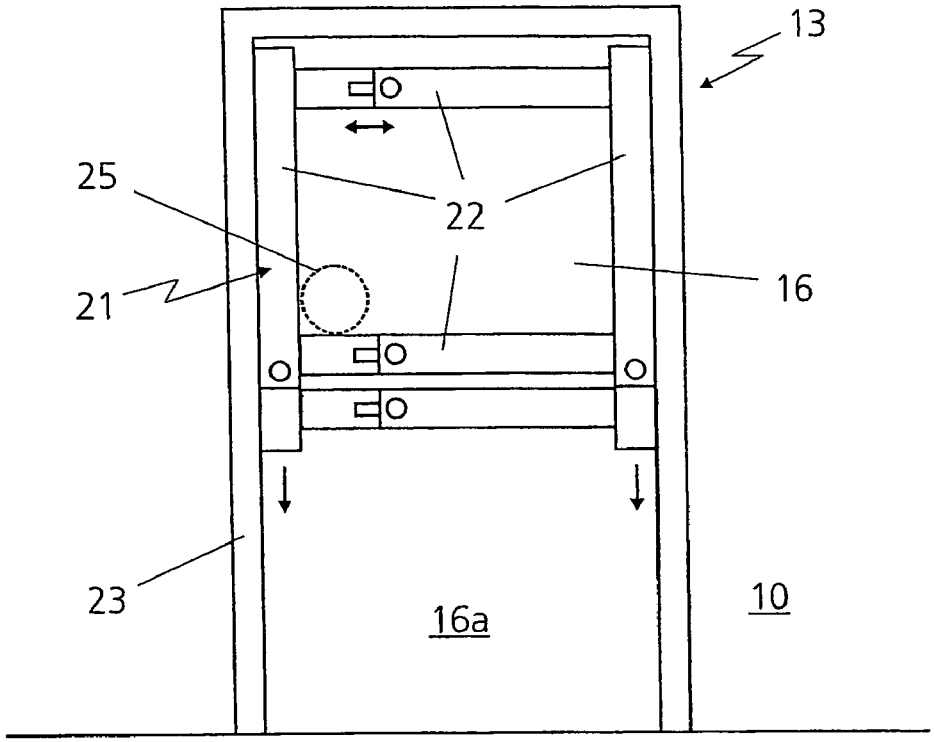
FIG. 9 illustrates a schematically simplified view of a building opening with a smoke control and fire protection device according to the invention in an alternative embodiment with a tensioning frame in the upper region which can be pulled out downwards optionally.
Figure 10:
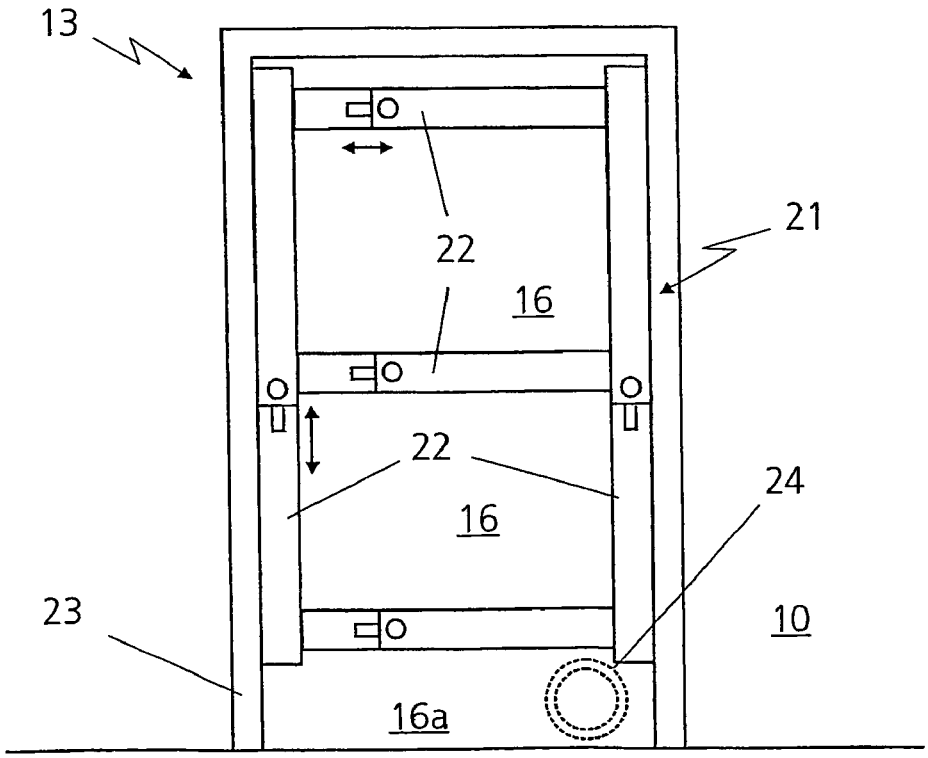
FIG. 10 illustrates a schematically simplified view of the alternative embodiment according to FIG. 9 with a downwardly pulled-out tensioning frame.

If a third horizontal frame member is present, as is shown in FIGS. 9 and 10, the very stable upper region formed by the frame 21 can be extended downwards when both lateral vertical frame members 22 are correspondingly extended telescopically downwards.

FIG. 9 illustrates a pushed in position of the adjustable tensioning and clamping frame 21 and FIG. 10 illustrates a position extended downwards. As can be seen, a high degree of stability for the protection device 13 is provided in this way.

As can also be seen from FIGS. 9 and 10, the sealing unit 16 is formed in two parts. Whereas in the upper region a flexible material is stretched between the adjustable frame members 22, the flexible material hangs downwards below the tensioning and clamping frame 21 as a type of curtain 16*a* and thereby closes the lower region of the opening. With lateral sealing strips, for example adhesive tapes, the laterally projecting parts of the curtain 16*a* can be attached to a door case 23 for sealing.

If the flexible material, for example, a fabric or a foil, is not elastic enough in the region of the tensioning and clamping frame 21 in order to enable adaptation to large openings, the fabric or the foil—just as in the lower region—can be formed correspondingly larger laterally and upwardly or downwardly and can correspondingly extend beyond the tensioning and clamping frame 21. By means of clamp members, not specified in more detail, after an extension and an adjustment of the frame members 22 to the opening to be sealed, the fabric or the foil correspondingly can then be clamped at the frame members 22 such that a stretched fabric results between the frame members 22. The fixing of the flexible material can also be carried out in a very simple manner by clamping between the tensioning and clamping frame 16 and the door case 23. Alternatively the fabric or foil can also be firmly connected at the two vertical longitudinal sides to the adjustable frame members 22. With different door widths, the fabric or the foil in practice must then be inserted so as to be correspondingly overlapping and/or folded. For the purpose of better cleaning, the fabric is fastened, for the purpose of a fixed connection, certainly not undetachably but, for example, by means of a hook-and-loop fastener to the frame members 22.

The adjustable frame members 22 can be fixed to one another by means of clamp screws and longitudinal slits after their adjustment into their positions.

To compensate tolerances, the frame members 22 can be provided on the outside with sealing members such as elastic sealing lips, for example, for better sealing to the door frame 23.

For a passage for persons, the protection device 13 is used in the position shown with the pushed in tensioning and clamping frame 21 represented in FIG. 9. When only fire hoses have to be pushed through or are pushed through, the lower third or even still less is sufficient as a lead-through opening, as is represented in FIG. 10 with an extended tensioning and clamping frame 21. Here, if only approximately ⅔ of the opening is closed in this way by the curtain 16*a*, it is possible in an emergency for fire fighters to also leave or enter the fire seat through this lead-through opening thereby formed.

Alternatively, it is also possible to form the tensioning and clamping frame 21 such that it covers the entire opening with the frame members 22 and thereby extends over the entire height. In this case, complete sealing is achieved if it is provided, for example, that a hose lead-through is provided or even a connection element 24 (in FIG. 10 shown by dashed lines) for a hose connection is provided in the lower region. In this further development stable materials can be provided as a sealing unit between the frame parts 21.

With a sufficiently stable design of the frame members 22 and the material for the sealing unit 16, a ventilator 25 (see representation in dashed lines in FIG. 9) can also be integrated in the protection device 13.

The protection device 13 can also, if required, be provided with a coolant or be connected to a coolant circuit (not shown). In this case, for example, the frame members 22 can be correspondingly filled with a coolant. The same also applies for the swelling elements 15. Also the sealing unit 16 can, for example, be formed from a double-sided fabric with a hollow space in between in which the coolant is disposed or through which the coolant flows. In a design with a coolant circuit, corresponding connections for a supply of chilled coolant and a discharge for this have to be provided. Alternatively, cooling is also possible by means of water flowing down over the protection device from above.

It is also advantageous if a light-transmissive material which is also easy to clean as far as possible is used as sealing device 16.

As can be seen, the protection device 13 can be installed quickly and without damage to a door frame so that subsequent damage is avoided.

According to the invention the possibility also exists that a closing element or a sealing element only partially covers up the opening to be closed so that the entire door opening is sealed only through the use of multiple devices. A possibility for this is described in principle on the basis of FIG. 12 in the following.

The sealing device 16 according to the invention—as mentioned—can be formed in one or more parts. The device, for example, can comprise two or three units. This means that in a first step a partial sealing of an opening in the upper region can be carried out and subsequently, a complete sealing of the opening with the second unit or, if applicable, also with a third unit. It is also possible with two or three such sealing units to seal, for example, doors situated one behind the other completely or at least in their respective upper regions in order to achieve in this way even better smoke sealing of an apartment, for example, with respect to the generally accessible hallway or stairwell areas.

Figure 11:
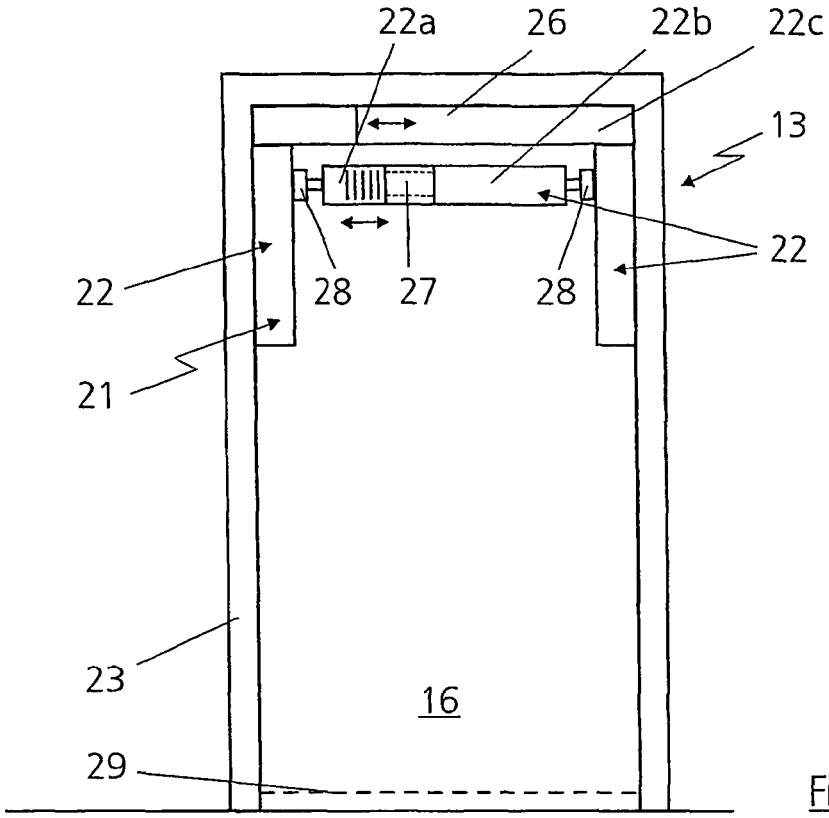
FIG. 11 illustrates a further alternative embodiment with tension rods.

In FIG. 11 a simple alternative embodiment is shown with two lateral frame members 22 and an upper frame member 22*c* comprising two elements that have a rectangular shape as viewed in cross-section and, through corresponding differences in dimension, are slidable into one another such that they are adjustable in terms of their width. For adaptation to the width of the respective opening of a door, for example, a horizontally adjustable frame member 22 is used comprising two tension rods 22*a* and 22*b*. Here, a tension rod can be provided with catches wherein, rough adaptation to the opening is achieved in the manner of a ratchet system. Fine adjustment subsequently takes place by means of a tension lock 27 between the two tension rods 22*a* and 22*b*, which tensioning lock 27 is provided for example by a screw. Alternatively, the entire tensioning lock 27 can also be spread apart after the first adaptation to the existing opening width by means of the ratchet system by the turning of the rod 27. In addition, if the tensioning lock is formed in the manner of a tightener with two counter-running screws, tightly fitting tension is achieved with a few rotational movements.

Other tensioning locks are also possible, of course, for bracing and/or clamping the two tension rods 22*a* and 22*b* in the opening. It is however advantageous if a quick tensioning lock is provided for this in any case. To guard against an inadvertent opening, securing members, such as, for example, securing pins can also be provided in one or in both tension rods and/or in the ratchet system.

To compensate tolerances or inclinations, both lateral ends of tension rods 22*a* and 22*b* can be provided with jointed connecting members 28, by means of which the two tension rods 22*a* and 22*b* can be pressed against the lateral frame members 22 and thereby achieve a bracing of the tensioning and clamping frame 21 against the door case.

The sealing unit 16 can be provided in the lower region, for example at the lower end, with weight elements, for example, an iron or lead band 29 (see dashed representation in FIG. 11).

This further development is particularly advantageous when a lightweight, flexible, high-temperature resistant fabric is used for the sealing unit 16. By means of the weight elements 29, good hanging of the sealing unit and therefore secure sealing is obtained.

Figure 12:
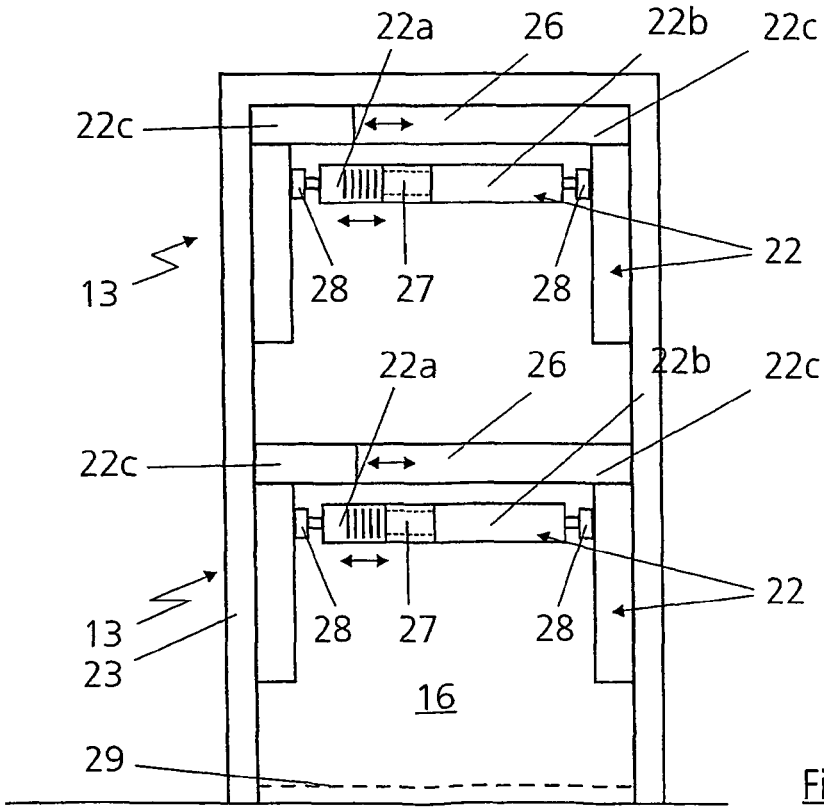
FIG. 12 illustrates an application possibility with two smoke control and fire protection devices employed one above the other in a door opening in each case in an alternative embodiment according to FIG. 11.

FIG. 12 shows a possible use in principle with two overlapping smoke control and fire protection devices 13 inserted in a door opening in an alternative embodiment as shown in FIG. 11. Other alternative embodiments, however, are also possible of course for common use in a door opening.

The advantage of using two devices in a door opening is that, inter alia, even greater security and stability is achieved in this way. Thus, a sealing of the door opening, for example, with only one device can occur in a first step according to FIG. 11, whereby the textile sealing unit 16 seals the door opening relatively loosely underneath the frame members and therefore easy access to the seat of the fire is possible. During and/or after completion of the extinguishing operations, the door opening can be sealed to a better degree by a second protection device 13 which is arranged under the first protection device disposed in the upper region. If the fire department has an alternative attack route available (e.g. through a window), it can completely seal the door opening by installing a second or even a third protection device so that almost complete sealing is achieved.

For flexible sealing units the most diverse materials are conceivable. A fabric with glass or metal fibers which is resistant to temperatures up to 600° C. has proven to be a very suitable sealing unit for the intended application purpose.

The method or the installation of the mobile smoke control and fire protection device 13, as illustrated in FIG. 11, is described in principle in the following: in a first step the device having a flexible sealing unit is folded out; the frame 21 with its adjustable frame members is placed in the upper region against the door case, for example, at the right upper corner; by pulling apart the two telescopic tension rods 22*a* and 22*b* of the horizontal frame member 22, the device is brought to the desired side of the door, with the upper frame member 22*c* simultaneously also being correspondingly expanded; a rough fitting follows by means of the ratchet-type pulling apart of the two tension rods 22*a* and 22*b* in connection with the catch. It is advantageous here if the ratchet system is formed such that it automatically locks during the pulling apart and, for example, the active release of a ratchet lever is necessary for the pushing together; while the device is held with one hand, the tensioning lock 27 is correspondingly turned with the other hand in the tightening direction whereby fine adjustment and with this secure clamping is achieved; and by pressing a securing means, not illustrated, for example, a securing pin, the two tension rods 22*a* and 22*b*, if necessary, can be additionally secured.

On account of the flexibility of the sealing unit 16, a passageway for persons in operation is possible, e.g., in an only slightly stooped position. Due to the rigidity of the special fabric and the incorporated weight elements, e.g., the lead band 29, a diffuse propagation of smoke is prevented on the one hand and, on the other hand, mechanical ventilation, if applicable, with ventilators is possible.

To remove the device it is necessary merely to turn the tensioning lock in the direction of "release" and—if applicable, after opening a securing pin or a stopping lever—the two tension rods 22*a* and 22*b* in addition to the frame member 22*c* can be pushed together again. After a possible space-saving folding up of the device, e.g. by rolling up the sealing unit 16, the device is then ready for the next use.

Since the protection device regularly comes in contact with fire smoke, good and simple cleaning is important. Therefore, the flexible fabric should be removable from the metal frame and able to be cleaned separately.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A mobile smoke control and fire protection device for buildings comprising a sealing unit that is attached in or at a wall opening having a bottom edge, an upper edge and first and second side edges, the mobile smoke control and fire protection device being adapted in terms of shape and size to the opening and being provided with at least one passage opening for people and/or with at least one lead-through opening for equipment, fire fighting equipment and the like, wherein the passage opening and/or the lead-through opening is at least partially covered, and an elongated vertical support member and a tensioning rod, the tensioning rod pressing the elongated vertical support member against the first side with sufficient force to support the sealing unit and the elongated vertical support member in a spaced relation above the bottom edge.

2. The mobile smoke control and fire protection device as claimed in claim 1, wherein the sealing unit is provided at least partially with a flexible material.

3. The mobile smoke control and fire protection device as claimed in claim 2, wherein the flexible material has a fabric or a foil that is resistant to high temperatures and that is resistant against the effect of flames.

4. The mobile smoke control and fire protection device as claimed in claim 3, wherein the fabric is provided at least partially with glass or metal fibers.

5. The mobile smoke control and fire protection device as claimed in claim 3, wherein the fabric is provided in a lower region with weight elements, in particular iron or lead elements.

6. The mobile smoke control and fire protection device as claimed in claim 1, wherein outer dimensions of the sealing unit can be altered.

7. The mobile smoke control and fire protection device as claimed in claim 6, wherein the sealing unit is provided at a circumference with expandable swelling elements for adaptation to the opening.

8. The mobile smoke control and fire protection device as claimed in claim 7, wherein the swelling elements are inflatable.

9. The mobile smoke and fire protection device as claimed in claim 8, wherein the inflatable swelling elements have a plurality of chambers.

10. The mobile smoke control and fire protection device as claimed in claim 1, wherein the sealing unit is provided with a tensioning or clamping frame.

11. The mobile smoke control and fire protection device as claimed in claim 10, wherein the frame is provided with adjustable frame members.

12. The mobile smoke and fire protection device as claimed in claim 11, wherein the adjustable frame members are telescopic.

13. The mobile smoke control and fire protection device as claimed in claim 12, wherein the telescopic frame members are provided with tension rods which are braced against each other.

14. The mobile smoke control and fire protection device as claimed in claim 1, wherein the sealing unit is provided in a lower region with a passage opening and/or a lead-through opening.

15. The mobile smoke control and fire protection device as claimed in claim 1, wherein the sealing unit is formed from two-part sealing elements or multi-part sealing elements.

16. The mobile smoke control and fire protection device as claimed in claim 15, wherein the sealing unit is provided in an upper region with a tensioning frame and is of flexible design at least in the lower region.

17. The mobile smoke control and fire protection device as claimed in claim 16, wherein the tensioning frame is designed such that it can be pulled out, unfolded or folded out in the direction of the lower region.

18. The mobile smoke control and fire protection device as claimed in claim 16, wherein a curtain which is resistant to high temperatures and resistant against the effect of flames is provided at least in the lower region, wherein the curtain forms a passage opening and/or a lead-through opening.

19. The mobile smoke control and fire protection device as claimed in claim 1, wherein the sealing unit is connected in a substantially smoke-proof manner to the wall, ceiling or the floor by sealing elements, adhesives, or adhesive tape.

20. The mobile smoke control and fire protection device as claimed in claim 1, wherein the sealing unit is provided with fastening elements with which the sealing unit is fastened to the wall, ceiling or the floor next to the opening.

21. The mobile smoke and fire protection device as claimed in claim 1, wherein the sealing unit is provided with peripherally-attached fastening means or guides which are inserted into punctiform or linear-shaped mating members such as recesses, bores, grooves or the like of a door frame or of a wall part next to the door.

22. The mobile smoke control and fire protection device as claimed in claim 1, wherein the sealing unit is provided with magnetic frame parts.

23. The mobile smoke control and fire protection device as claimed in claim 1, wherein the opening sealing unit is provided with a closure element, such as a zipper or a hook-and-loop fastener, for the formation of at least one passage and/or lead-through opening.

24. The mobile smoke control and fire protection device as claimed in claim 1, wherein the sealing unit is provided in a lower region with a passage opening for the lead-through of a hose.

25. The mobile smoke control and fire protection device as claimed in claim 1, wherein the sealing unit has, in a lower region, an attachment element for a hose.

26. The mobile smoke control and fire protection device as claimed in claim 1, wherein the sealing unit is provided at least partially with coolants or with a coolant circuit.

27. The mobile smoke control and fire protection device as claimed in claim 1, wherein the sealing unit is provided with a ventilator.

28. The mobile smoke control and fire protection device as claimed in claim 1, wherein the sealing unit is provided in a lower region with lateral sealing elements and is designed to fold open to form a passage opening and/or a lead-through opening.

29. A method for preventing a propagation of smoke and fire in buildings, the method comprising:

providing a sealing unit that is fitted in or adapted to an opening of a wall having a bottom and first and second spaced, substantially parallel sides, the sealing unit being provided with at least one passage opening for people and/or with at least one lead-through opening for equipment for fire fighting, the sealing unit having an elongated vertical support member fixedly attached to a tensioning rod;

fitting the sealing unit into the opening such that it seals at least in an upper opening region or in regions, placing the elongated vertical support member against the first side and a first end of the tensioning rod against the vertical support member; and pressing the elongated vertical support member against the first side with the tensioning rod with sufficient force to support the sealing unit and the elongated vertical support member in a spaced relation above the bottom.

30. The method as claimed in claim 29, wherein the sealing unit is fitted into a door case by expandable swelling elements arranged at a periphery of the sealing unit.

31. The method as claimed in claim 29, wherein the sealing unit is clamped into a door case by a frame.

32. The method as claimed in claim 31, wherein telescopic tension rods of the frame are clamped into the case after unfolding, pulling out or folding out the sealing unit.

33. A mobile smoke control and fire protection device for buildings configured to be mounted in an opening having first and second opposed sides, the device comprising:

a frame comprising first and second spaced, substantially parallel side members having first and second ends, outer faces adapted to engage the first and second opposed sides of the opening and opposed inner faces and at least one telescoping transverse frame member extending between the opposed inner faces from a location on the inner face of the first side member between the first and second ends of the first side member and a location on the inner face of the second side member between the first and second ends of the second side member;

a fire-resistant sheet of flexible material having at least one selectively closable passage and connected to said first and second substantially parallel spaced frame members; and at least one clamp for securing the at least one telescoping transverse frame member at one of a plurality of telescoped positions such that the smoke control device is mountable in openings having different distances between the first and second opposed sides.

34. The mobile smoke control and fire protection device as claimed in claim 33, wherein said at least one telescoping transverse frame member comprises first and second parallel telescoping transverse frame members.

35. The mobile smoke control and fire protection device as claimed in claim 34, including a first telescoping element in said first side member and a second telescoping element in said second side member and a third telescoping transverse frame member connected between said first telescoping element and said second telescoping element.

36. The mobile smoke control and fire protection device as claimed in claim 1, wherein the sealing unit forms a seal with the upper edge.

* * * * *